US009431003B1

(12) United States Patent
Cecchi et al.

(10) Patent No.: US 9,431,003 B1
(45) Date of Patent: Aug. 30, 2016

(54) IMBUING ARTIFICIAL INTELLIGENCE SYSTEMS WITH IDIOMATIC TRAITS

(71) Applicant: INTERNATIONAL BUSINESS MACHINES CORPORATION, Armonk, NY (US)

(72) Inventors: Guillermo A. Cecchi, New York, NY (US); James R. Kozloski, New Fairfield, CT (US); Clifford A. Pickover, Yorktown Heights, NY (US); Irina Rish, Rye Brook, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/671,111

(22) Filed: Mar. 27, 2015

(51) Int. Cl.

| | |
|---|---|
| ***G10L 13/00*** | (2006.01) |
| ***G10L 13/033*** | (2013.01) |
| ***G10L 13/04*** | (2013.01) |
| ***G10L 13/08*** | (2013.01) |
| *G10L 19/00* | (2013.01) |

(52) U.S. Cl.
CPC ..... *G10L 13/033* (2013.01); *G10L 13/04* (2013.01); *G10L 13/08* (2013.01)

(58) Field of Classification Search
CPC ..... G10L 13/02; G10L 13/033; G10L 13/04; G10L 13/047; G10L 13/08; G10L 13/06
USPC ..... 704/220, 235, 258, 260, 275
See application file for complete search history.

(56) References Cited

PUBLICATIONS

U.S. Appl. No. 14/288,751, filed May 28, 2014.

*Primary Examiner* — Thierry L Pham
(74) *Attorney, Agent, or Firm* — Law Office of Jim Boice

(57) ABSTRACT

Speech traits of an entity imbue an artificial intelligence system with idiomatic traits of persons from a particular category. Electronic units of speech are collected from an electronic stream of speech that is generated by a first entity. Tokens from the electronic stream of speech are identified, where each token identifies a particular electronic unit of speech from the electronic stream of speech, and where identification of the tokens is semantic-free. Nodes in a first speech graph are populated with the tokens to develop a first speech graph having a first shape. The first shape is matched to a second shape of a second speech graph from a second entity in a known category. The first entity is assigned to the known category, and synthetic speech generated by an artificial intelligence system is modified based on the first entity being assigned to the known category.

20 Claims, 10 Drawing Sheets

IMBUING ARTIFICIAL INTELLIGENCE SYSTEMS WITH IDIOMATIC TRAITS

BACKGROUND

The present disclosure relates to the field of cognitive devices, and specifically to the use of cognitive devices that emulate human speech. Still more particularly, the present disclosure relates to emulating human speech of a particular dialect used by a specific cohort.

Artificial systems that produce speech and text for human communication are based on expert systems being optimized to maximize domain-based functionality, such as customer satisfaction, based on immediate, conscious customer feedback. These systems are not designed to display the slightly dysfunctional or idiosyncratic features present in all human speech. That is, human beings typically speak in non-uniform ways, due to regional dialects, training, occupation, etc. That is, a doctor from New England is likely to have a speech pattern that is different from that of a lawyer from California, due to their different backgrounds, daily lexicons, etc.

When an artificial system generates speech, either in the form of written text or as audible speech, the generated speech will typically be lacking speech nuances that are inherent in true human speech, thus leading to an "uncanny valley" of difference, which refers to an artificial system being just different enough from a real person to be unsettling, even if the observer does not know why.

SUMMARY

A method, system, and/or computer program product imbues an artificial intelligence system with idiomatic traits. Electronic units of speech are collected from an electronic stream of speech that is generated by a first entity. Tokens from the electronic stream of speech are identified, where each token identifies a particular electronic unit of speech from the electronic stream of speech, and where identification of the tokens is semantic-free. Nodes in a first speech graph are populated with the tokens, and a first shape of the first speech graph is identified. The first shape is matched to a second shape, where the second shape is of a second speech graph from a second entity in a known category. The first entity is assigned to the known category, and synthetic speech generated by an artificial intelligence system is modified based on the first entity being assigned to the known category, such that the artificial intelligence system is imbued with idiomatic traits of persons in the known category.

DETAILED DESCRIPTION

Figure 1:
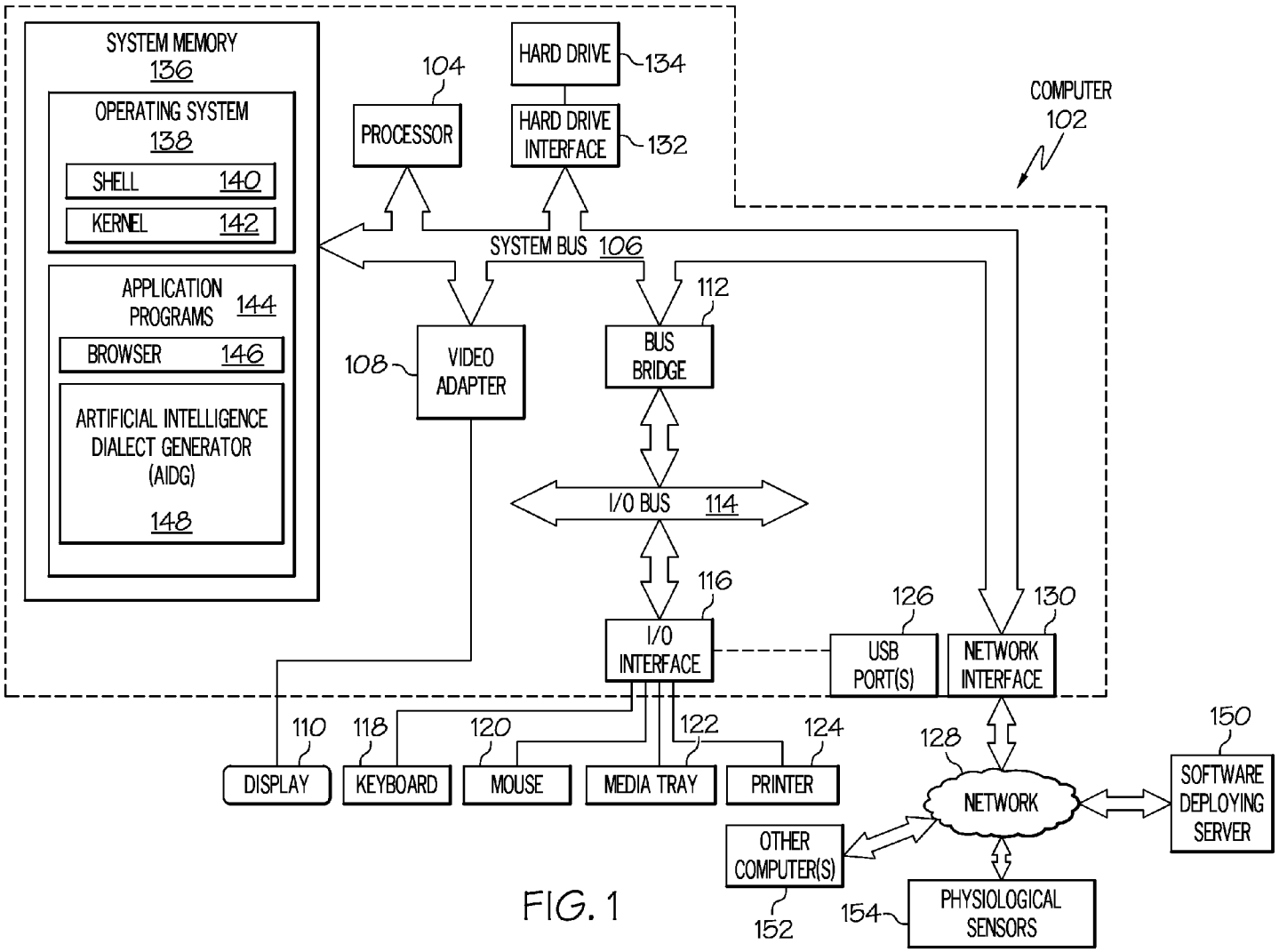
FIG. 1 depicts an exemplary system and network in which the present disclosure may be implemented.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

As used herein, the term "idiomatic" is defined as describing human speech, in accordance with human usage of particular terminologies, inflections, words, and/or phrases when speaking and/or writing. Thus, "idiomatic traits" of speech (both written and verbal/oral) are those of humans when speaking/writing. In one or more embodiments of the present invention, the "idiomatic traits" are for humans from a particular demographic group, region, occupation, and/or who otherwise share a particular set of traits/profiles.

Similarly, the term "dialect" is defined as characteristics of human speech, both written and verbal/oral, to include but not be limited to usage of particular terminologies, inflections, words, and/or phrases. Thus, "dialectal traits" of speech (both written and verbal/oral) are those of humans when speaking/writing. In one or more embodiments of the present invention, the "dialectal traits" are for humans from a particular demographic group, region, occupation, and/or who otherwise share a particular set of traits/profiles.

With reference now to the figures, and in particular to FIG. 1, there is depicted a block diagram of an exemplary system and network that may be utilized by and/or in the implementation of the present invention. Note that some or all of the exemplary architecture, including both depicted hardware and software, shown for and within computer 102 may be utilized by software deploying server 150 and/or other computer(s) 152.

Exemplary computer 102 includes a processor 104 that is coupled to a system bus 106. Processor 104 may utilize one or more processors, each of which has one or more processor cores. A video adapter 108, which drives/supports a display 110, is also coupled to system bus 106. System bus 106 is coupled via a bus bridge 112 to an input/output (I/O) bus 114. An I/O interface 116 is coupled to I/O bus 114. I/O interface 116 affords communication with various I/O devices, including a keyboard 118, a mouse 120, a media tray 122 (which may include storage devices such as CD-ROM drives, multi-media interfaces, etc.), a printer 124, and external USB port(s) 126. While the format of the ports connected to I/O interface 116 may be any known to those skilled in the art of computer architecture, in one embodiment some or all of these ports are universal serial bus (USB) ports.

As depicted, computer 102 is able to communicate with a software deploying server 150, using a network interface 130. Network interface 130 is a hardware network interface, such as a network interface card (NIC), etc. Network 128 may be an external network such as the Internet, or an internal network such as an Ethernet or a virtual private network (VPN).

A hard drive interface 132 is also coupled to system bus 106. Hard drive interface 132 interfaces with a hard drive 134. In one embodiment, hard drive 134 populates a system memory 136, which is also coupled to system bus 106. System memory is defined as a lowest level of volatile memory in computer 102. This volatile memory includes additional higher levels of volatile memory (not shown), including, but not limited to, cache memory, registers and buffers. Data that populates system memory 136 includes computer 102's operating system (OS) 138 and application programs 144.

OS 138 includes a shell 140, for providing transparent user access to resources such as application programs 144. Generally, shell 140 is a program that provides an interpreter and an interface between the user and the operating system. More specifically, shell 140 executes commands that are entered into a command line user interface or from a file. Thus, shell 140, also called a command processor, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 142) for processing. Note that while shell 140 is a text-based, line-oriented user interface, the present invention will equally well support other user interface modes, such as graphical, voice, gestural, etc.

As depicted, OS 138 also includes kernel 142, which includes lower levels of functionality for OS 138, including providing essential services required by other parts of OS 138 and application programs 144, including memory management, process and task management, disk management, and mouse and keyboard management.

Application programs 144 include a renderer, shown in exemplary manner as a browser 146. Browser 146 includes program modules and instructions enabling a world wide web (WWW) client (i.e., computer 102) to send and receive network messages to the Internet using hypertext transfer protocol (HTTP) messaging, thus enabling communication with software deploying server 150 and other computer systems.

Application programs 144 in computer 102's system memory (as well as software deploying server 150's system memory) also include an Artificial Intelligence Dialect Generator (AIDG) 148. AIDG 148 includes code for implementing the processes described below, including those described in FIGS. 2-10. In one embodiment, computer 102 is able to download AIDG 148 from software deploying server 150, including in an on-demand basis, wherein the code in AIDG 148 is not downloaded until needed for execution. Note further that, in one embodiment of the present invention, software deploying server 150 performs all of the functions associated with the present invention (including execution of AIDG 148), thus freeing computer 102 from having to use its own internal computing resources to execute AIDG 148.

Also coupled to computer 102 are physiological sensors 154, which are defined as sensors that are able to detect physiological states of a person. In one embodiment, these sensors are attached to the person, such as a heart monitor, a blood pressure cuff/monitor (sphygmomanometer), a galvanic skin conductance monitor, an electrocardiography (ECG) device, an electroencephalography (EEG) device, etc. In one embodiment, the physiological sensors 154 are part of a remote monitoring system, such as logic that interprets facial and body movements from a camera (either in real time or recorded), speech inflections, etc. to identify an emotional state of the person being observed. For example, voice interpretation may detect a tremor, increase in pitch, increase/decrease in articulation speed, etc. to identify an emotional state of the speaking person. In one embodiment, this identification is performed by electronically detecting the change in tremor/pitch/etc., and then associating that change to a particular emotional state found in a lookup table.

Note that the hardware elements depicted in computer 102 are not intended to be exhaustive, but rather are representative to highlight essential components required by the present invention. For instance, computer 102 may include alternate memory storage devices such as magnetic cassettes, digital versatile disks (DVDs), Bernoulli cartridges, and the like. These and other variations are intended to be within the spirit and scope of the present invention.

When an artificial system generates written or oral synthetic speech, a lack of quirks (i.e., idiosyncrasies found in real human speech) contributes to the sense of an artificial experience by human users, even when it is not explicitly expressed (e.g., in a customer survey from customers who are interacting with an enterprise's artificial system, such as an Interactive Voice Response—IVR system). The present invention presents an artificial system with recognizable human traits that include small non-disruptive quirks found in human speech, thus contributing to a more satisfactory user-computer interaction.

Disclosed herein is a system of machine learning, graph theoretic techniques, and natural language techniques to implement real-time analysis of human behavior, including speech, to provide quantifiable features extracted from in-person interviews, teleconferencing or offline sources (email, phone) for categorization of psychological states. The system collects and analyzes both real time and offline behavioral streams such as speech-to-text and text (and in one or more embodiments, video and physiological measures such as heart rate, blood pressure and galvanic skin conductance can augment the speech/text analysis).

Speech and text data are analyzed online (i.e., in real time) for a multiplicity of features, including but not limited to semantic content and syntactic structure in a transcribed text, as well as an emotional value of the speech/text as determined from audio, video and/or physiological sensor streams. The analysis of individual text/speech is combined with an analysis of similar streams produced by one or more populations/groups/cohorts.

Although the term "speech" is used throughout the present disclosure, it is to be understood that the process described herein applies to both verbal (oral/audible) speech as well as written text.

In one or more embodiments of the present invention, the construction of graphs representing structural elements of speech is based on a number of parameters, including but not limited to syntactic values (article, noun, verb, adjective, etc.), lexical root (e.g., run/ran/running) for nodes of a speech graph, and text proximity for edges between nodes in a speech graph. However, in a preferred embodiment of the present invention, the semantics (i.e., meaning) of the words is irrelevant. Rather, it is merely the non-semantic structure (i.e., distance between words, loops, etc.) that defines features of the speaker.

Graph features such as link degree, clustering, loop density, centrality, etc., represent speech structure. Similarly, in one or more embodiments the present invention uses various processes to extract semantic vectors from the text, such as a latent semantic analysis. These methods allow the computation of a distance between words and specific concepts (e.g., emotional state, regional dialects/lexicons, etc.), such that the text can be transformed into a field of distances to a concept, a field of fields of distances to an entire lexicon, and/or a field of distances to other texts including books, essays, chapters and textbooks.

The syntactic and semantic features are combined to construct locally embedded graphs, so that a trajectory in a high-dimensional feature space is computed for each text.

The trajectory is used as a measure of coherence of the speech, as well as a measure of distance between speech trajectories using methods such as Dynamic Time Warping. The extracted multi-dimensional features are then used as predictors for cognitive states of a person interacting with the artificial intelligence system. Example of such cognitive states may be emotional (e.g., bored, impatient, etc.) and/or intellectual (e.g., the level of understanding that a person has in a particular area).

The features extracted are then categorized for an entire population for which linguistic and cognition expert systems labels for cognitive, emotional, and linguistic states are deemed as nominal for a reference population. The categorization of traits with their associated analytic features are then used to bias the production of speech and text by artificial systems, such that the systems will reflect the cognitive, emotional, and linguistic features of the reference population.

As described herein, the present invention uses cognitive/psychological/linguistic signatures of humans to bias Artificial Intelligence (AI) systems that produce text/speech, thereby introducing some human "noise" (e.g., inflections) into the underlying text/speech.

The injection of one or more cognitive/psychological signatures into an artificial entity, a Question and Answer (Q&A) entity, a sales entity, an advertising entity, and/or an artificial companion for persons serves many purposes in the generation of nuance-imbued synthetic speech.

For example, consider an automated customer service that allows a customer to choose from a menu of service automata with different traits. The traits do not have to be explicitly offered to the customers, but may be based on an analysis of the cognitive/psychological traits demonstrated by the customer through his/her speech. For example, assume that automaton A (from an automated customer service) generates speech/text in a pattern that is perceived as being highly detail oriented, while automaton B generates speech/text in a pattern that is perceived as being more casual (less detail oriented). If a customer's speech patterns identifies him/her as being highly detail oriented, then he/she is likely to be more comfortable interacting with automaton A, rather than automaton B.

Similarly, for AI companion systems and toys, service robots, etc. (such as domestic and nursing robots), the user may want a robot to be more closely aligned with the cognitive/psychological traits of the user.

Likewise, in a Virtual World, an artificial entity represented by an avatar may be given one or more human-like traits that match with the cognitive/psychological traits of the user, thus making it more suitable or engaging as a companion for the user, a sales agent trying to sell a product or service, a health care provider avatar providing information in an empathetic manner, etc.

Thus, AI conversations (which are enhanced to be more human in one or more ways) may also include conversations on a phone (or text chats on a phone). In order to increase the confidence level that a categorization of the user (person having a phone conversation with the AI automaton) is correct, a history of categorization may be maintained, along with how such categorization was useful, or not useful, in the context of injecting human-like traits into AI entities. Thus, using active learning, related and/or current features and/or categorizations can be compared to past categorizations and features in order to improve accuracy, thereby improving the performance of the system in providing companionship, closing deals, making diagnoses, etc.

Figure 2A:
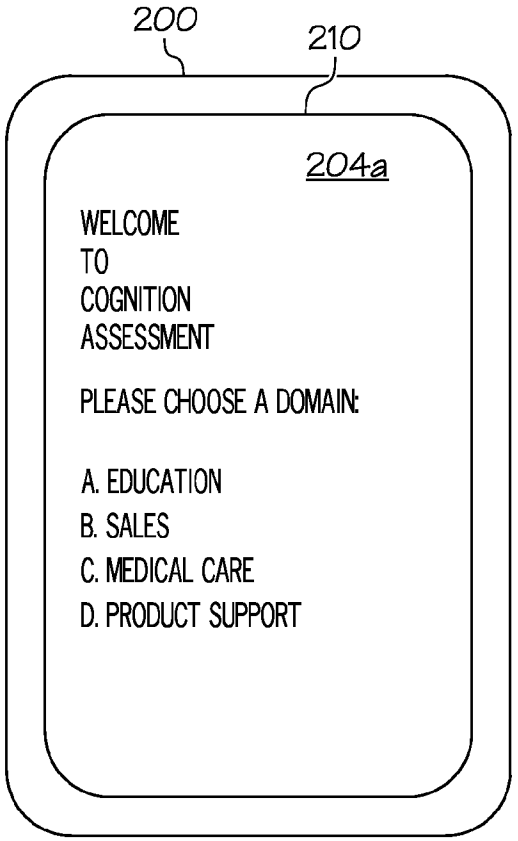
FIGS. 2*a*-2*c* and FIGS. 3*a*-3*b* illustrate an exemplary electronic device in which semantic-free speech analysis can be implemented.

With reference now to FIG. 2*a*, an exemplary electronic device 200, which may contain one or more inventive components of the present invention, is presented. Electronic device 200 may be implemented as computer 102 and/or other computer(s) 152 depicted in FIG. 1. Embodiment electronic device 200 may be a highly-portable device, such as a "smart" phone, or electronic device 200 may be a less portable device, such as a laptop/tablet computer, or electronic device 200 may be a fixed-location device, such as a desktop computer.

Figure 2B:
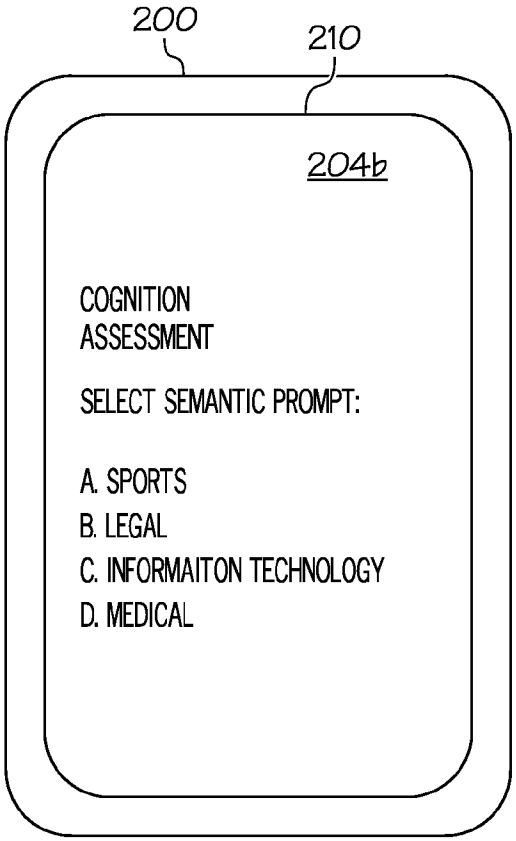
Figure 2C:
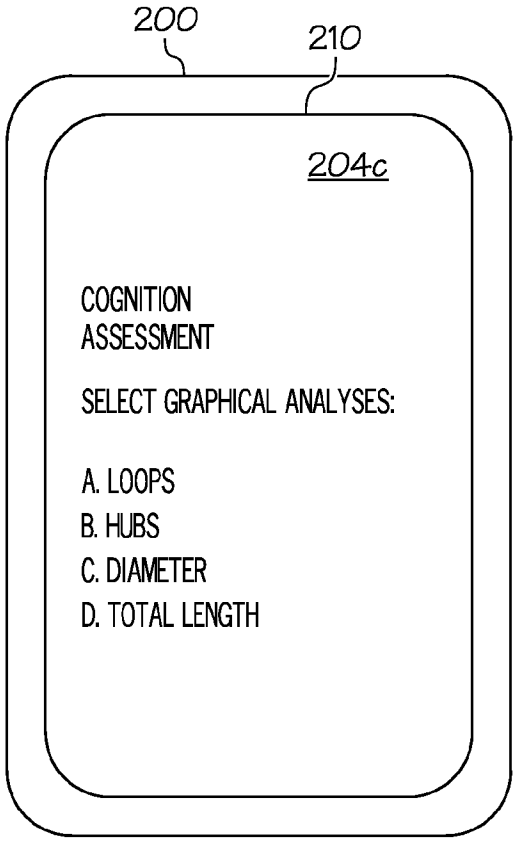

Electronic device 200 includes a display 210, which is analogous to display 110 in FIG. 1. Instructions related to and/or resulting from the processes described herein are presented on display 210 via various screens (i.e., displayed information). For example, initial parameter screens 204*a*-204*c* in corresponding FIGS. 2*a*-2*c* present information to be selected for initiating a cognition assessment. Assume that electronic device 200 is a device that is being used by an Information Technology (IT) system and/or professional who is developing speech synthesis for an Artificial Intelligence (AI) system. As depicted in FIG. 2*a*, the IT professional is given multiple options in screen 204*a* from which to choose, where each of the options describes a particular subject area in which the AI system will be operating. That is, different AI systems are devoted to different fields, ranging from education, sales, health care, customer product support, etc. As such, each field has 1) different types of persons who will be interacting with the AI system, who 2) use different languages/terminologies specific for the field, and/or 3) are in various cognitive/emotion states.

In the example shown, the user (the IT professional) has selected the option "A. Education", which is selected if the IT professional wishes to modify synthetic speech for use in the field of presenting educational materials. The selection of option A results in the display 210 displaying new screen 204*b*, which presents sub-categories of "Education", including the selected option "D. Medical". That is, the IT professional wants the AI system to generate synthetic speech used to provide educational material (verbal or written) to medical experts (i.e., health care experts such as physicians, nurses, etc.)

After choosing one or more of the options shown on screen 204*b*, another screen 204*c* populates the display 210, asking the user for a preferred type of graphical analysis to be performed on the speech pattern of a person who will be receiving the medical education. In the example shown, the user has selected option "A. Loops" and "D. Total length". As described in further detail below, these selections let the system know that the user wants to analyze a speech graph for that person according to the quantity and/or size of loops found in the speech graph, as well as the total length of the speech graph (i.e., the nodal distance from one side of the speech graph to an opposite side of the speech graph, and/or how many nodes are in the speech graph, and/or a length of a longest unbranched string of nodes in the speech graph, etc.). The reason for the user choosing these analyses over others may derive from intelligence of the AI system (e.g., that knows that the analysis of loops and length of a speech graph is optimal for determining the preferred type of synthetic speech to present educational material to a person in the health care business), the user's experience, advice derived from the tool's documentation, professional publications on the matter, or general training on the use of the tool, so that these specific analyses of speech produced will be most informative when making the determination.

Once the particular type of speech graph analysis is selected, based on the choice(s) made on screen 204*c*, an analysis of the health care professional's speech is performed, using a speech graph analysis described below. That is, a sample of the person who will be receiving medical education from the Artificial Intelligence (AI) system (i.e., the "student") will be taken. In one or more embodiments, this sample is the result of a questionnaire, in which the student is asked various questions, used to elicit an understanding of the student's educational background, current emotional state, regional dialect, etc. The result of this analysis is presented as a speech pattern dot 306 on the speech pattern radar chart 308 shown in FIG. 3*a*.

Figure 3B:
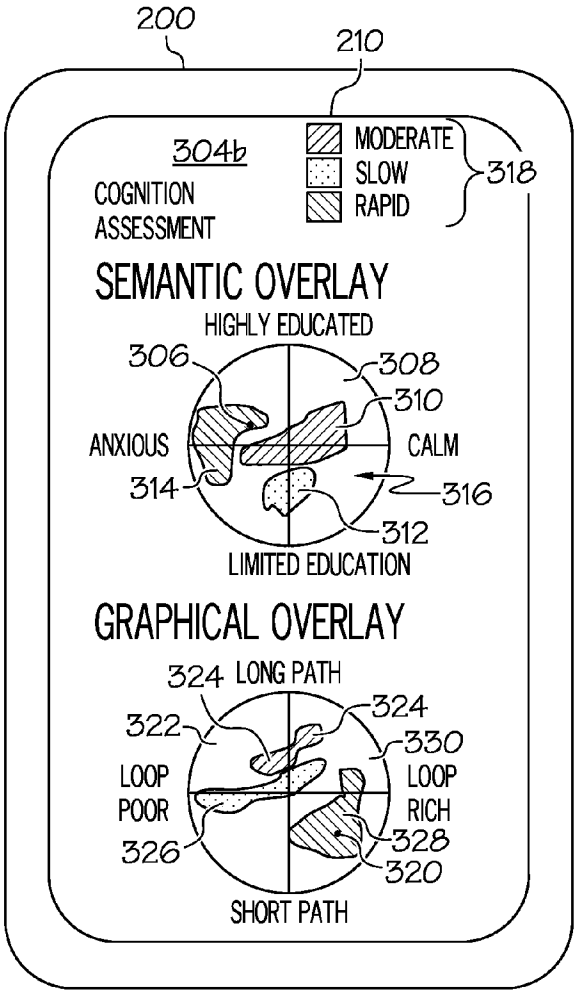
Figure 3A:
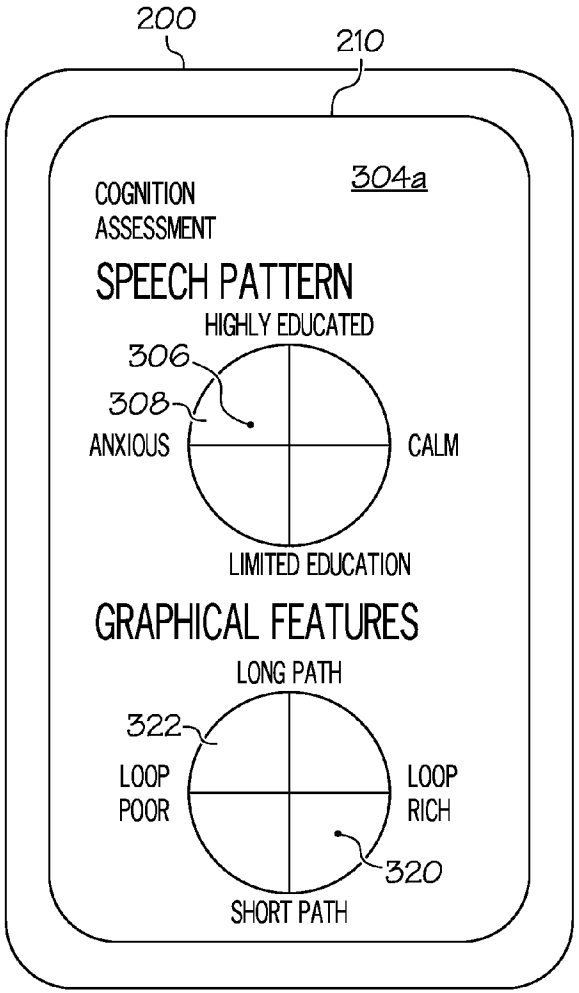

As shown in FIG. 3*a*, the speech pattern revealed from the speech analysis of the student shows on analysis screen 304*a* that the timing and/or order of words spoken indicate that the student is highly educated, but is currently feeling anxious, as indicated by the position of the speech pattern doe 306 on the speech pattern radar chart 308. Note that this analysis is not based on what the student says (i.e., by looking at key words or phrases known to be indicative of certain types of education, certain emotional states, etc.), but rather the pattern of words spoken by the student, as described below.

However, semantic analysis can be used in one or more embodiments to assign the particular student (or other user of the AI system) to a particular cohort. Thus, as depicted in the screen 304*b* in FIG. 3*b*, the speech pattern radar chart 308 from FIG. 3*a* (along with speech pattern dot 306, indicating the current speech sample from the student) is overlaid with semantic pattern clouds 310, 312, and 314 to form a semantic pattern overlay chart 316. These semantic pattern clouds (310, 312, 314) are the result of analyses of past studies of the semantics of persons' speech, in order to relate to how well persons of certain educational backgrounds and certain current emotional states respond to certain patterns of speech (assuming that the AI system synthetically generates verbal speech to present educational information to the health care student). That is, some persons prefer that spoken information be presented using rapid speech, while others prefer a slower, more deliberate speech pattern, and yet others prefer a moderate speech pattern, which is neither fast or slow (all of which are predefined and/or predetermined based on standard speech patterns for one or more cohorts of persons).

As defined in legend 318, semantic cloud 310 identifies students that respond best to verbal instruction that is spoken (synthetically or otherwise) at a moderate pace; semantic cloud 312 identifies students that respond best to verbal instruction that is spoken at a slow pace; and semantic cloud 314 identifies students that respond best to verbal instruction that is spoken at a rapid pace.

The scale and parameters used by speech pattern radar chart 308 and semantic overlay chart 316 are the same. Thus, since speech pattern dot 306 (for the current student) falls within semantic cloud 314, the system determines that this student responds best to verbal instruction that is spoken at a rapid pace (i.e., the synthetic speech is fast).

While the present invention has been presented in FIG. 3*b* as utilizing both speech graph patterns and semantic features (meaning of words spoken by the student and/or control group) to determine how a student will best respond to verbal instruction, a preferred embodiment of the present invention does not rely on semantic features of the speech of the student to determine the optimal synthetic speech used. Rather, the shape of the speech pattern (as graphed in FIG. 3*a*) of the student alone is able to make this determination.

For example, in analysis screen 304*a* of FIG. 3*a*, graphical radar graph 322 describes only the physical shape/appearance of a speech graph, without regard to the meaning of any words that are used to make up the speech graph (as used in FIG. 3*b*). By detecting the position of the speech pattern dot 306 on the speech pattern radar graph 308, a determination can be made regarding the preferred speech pattern to be used by the AI system. For example, a lookup table may indicate that persons represented by the speech pattern dot 306 on the speech pattern radar graph 308 will best respond to rapid synthetic speech from the AI system, just as was determined by the semantic cloud 314 in FIG. 3*b*. However, no semantic analysis is needed if the lookup table is used.

As described herein, both the speech pattern radar graph 308 and the speech pattern dot 306 in FIG. 3*a* are semantic-independent (i.e., are not concerned with what the words mean, but rather are only concerned about the shape of the speech graph).

As further shown in FIG. 3*a*, a graphical dot 320 in a graphical radar graph 322 indicates that the speech graph of the student/person whose speech is presently being analyzed has many loops ("Loop rich"), but there are no long chains of speech token nodes ("Short path").

With reference again to FIG. 3*b*, this same graphical radar graph 322 is overlaid with graphical clouds 324, 326, and 328 (as well as graphical dot 320) to create a graphical overlay chart 330. As still defined in legend 318, graphical cloud 324 indicates, by showing the region in the radar graph where past analyses of other labeled individuals' speech and their corresponding points fall, where different types of people fall. That is, persons with speech patterns that are loop poor or loop rich, and/or have long paths or short paths, have demonstrated in past studies that they prefer to listen to certain types of speech patterns, and/or learn better when listening to certain speech patterns. Based on these parameters, graphical cloud 324 shows that persons who have long paths in their speech patterns (but are neither loop rich nor loop poor) prefer to hear words spoken at a moderate pace. Graphical cloud 326 shows that persons whose speech graphs are loop poor (but have neither long paths nor short paths) prefer to hear (and/or learn better when listening to) slowly articulated speech. Graphical cloud 328 shows that persons whose speech graphs are loop rich and have short paths prefer to listen to speech that is rapid. These graphical clouds (324, 326, 328) are the result of analyzing the speech graphs (described in detail below) of words spoken by persons who, respectively, are now known to have certain educational backgrounds and/or certain current emotional states.

The scale and parameters used by graphical radar chart 322 and graphical overlay chart 330 are the same. Thus, since graphical dot 320 (for the student whose speech is presently being analyzed) falls within graphical cloud 328, the system determines that this person likely prefers to listen to speech (human or synthesized) that is rapid.

Figure 4:
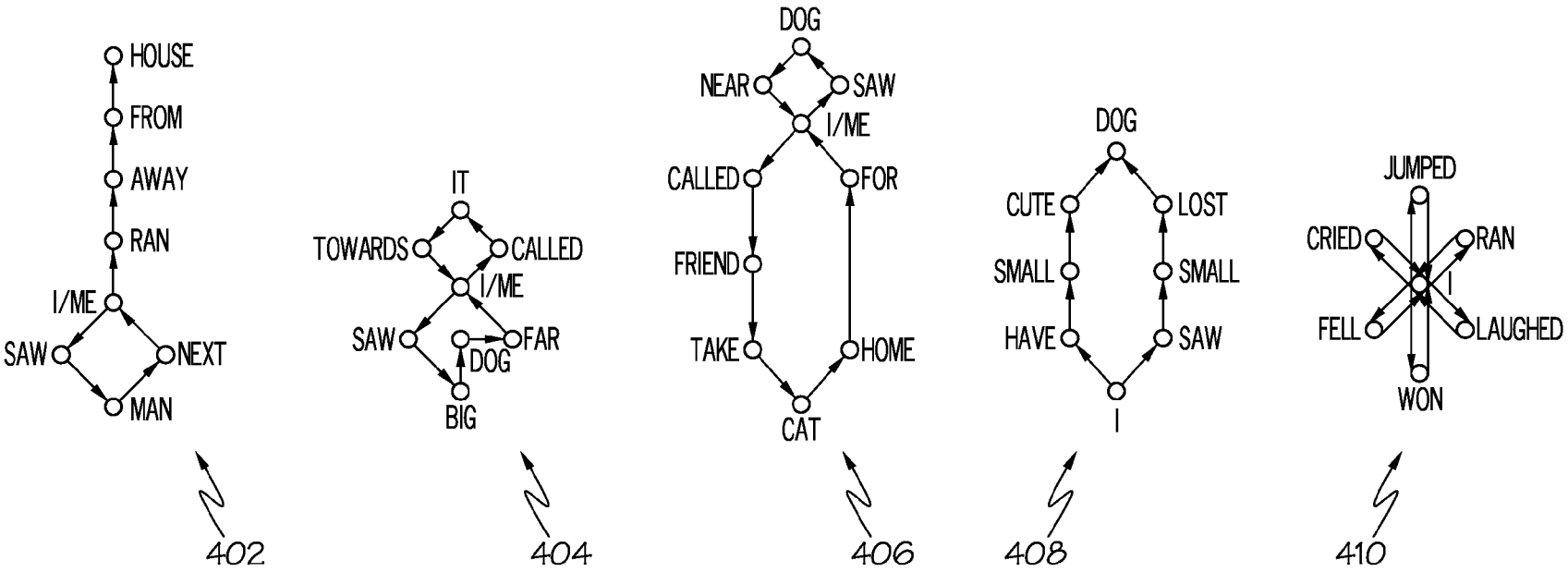
FIG. 4 depicts various speech graph shapes that may be used by the present invention.

As indicated above and in one or more embodiments, the present invention relies not on the semantic meaning of words in a speech graph, but rather on a shape of the speech graph, in order to identify certain features of a speaker (e.g., a prospective student, a customer, an adversary, a co-worker, etc.). FIG. 4 thus depicts various speech graph shapes that may be used by the present invention to analyze the mental, emotional, and/or physical state of the person whose speech is being analyzed. Note that in one embodiment of the present invention, the meanings of the words that are used to create the nodes in the speech graphs shown in FIG. 4 are irrelevant. Rather, it is only the shape of the speech graphs that matters. This shape is based on the size of the speech graph (e.g., the distance from one side of the graph to the opposite side of the graph; how many nodes are in the graph, etc.); the level of branching between nodes in the graph; the number of loops in the graph; etc. Note that a loop may be for one or more nodes. For example, if the speaker said "Hello, Hello, Hello", this would result in a one-node loop in the speech graph, which recursively returns to the initial token/node for "Hello". If the speaker said "East is East", this would result in a two-node loop having two tokens/nodes ("East/is/(East)"), in which the loop goes from the node for "East" to the node "is" and then back to the node for "East". If the speaker said "I like the old me", then the tokens/nodes would be "I/like/old/(me)", thus resulting in a three-node loop. Additional speech graph shapes are depicted in FIG. 4.

With reference to speech graph 402 in FIG. 4, assume that the speaker said the following: "I saw a man next to me, and I ran away from my house." This sentence is then partitioned into electronic units of speech called "tokens" (divided by slash marks), resulting in the tokens "I/saw/man/next/me/ran/away/from/house". These tokens then populate the token nodes (also simply called "nodes") that make up the speech graph 402. Notice that speech graph 402 has only one loop (I/saw/man/next), but is rather long dimensionally (i.e., from top to bottom), due to the unbranched token chain (I/ran/away/from/house). Note that speech graph 402 also has a branch at the node for "I", where the speech branches to the loop (saw/man/next) and then branches to the linear chain (ran/away/from/house). Note that the tokenization of speech herein described as corresponding to words, may or may not have a 1 to 1 correspondence as such. For example, analyses may tokenize phrases, or other communicative gestures, produced by an individual. Examples of communicative gestures include verbal utterances that are not language related (i.e., gasps, sighs, etc.), as well as non-verbal gestures (i.e., shoulder shrugs, grimaces, etc. captured by a camera). In addition, the tokenization here takes recognized speech that has been transcribed by a human or by a speech to text algorithm. Such transcription may not be used in certain embodiments of the present invention. For example, an analysis of recorded speech may create tokens based on analysis of speech utterances that does not result in transcribed words. These tokens may for example represent the inverse mapping of speech sounds to a set of expected movement of the speaker's vocal apparatus (full glottal stop, fricative, etc.), and therefore may extend to speakers of various languages without the need for modification. In all embodiments, note that the tokens and their generation is semantic-independent. That is, it is the word itself, and not what the word means, that is being graphed, such that the speech graph is initially semantic-free.

Speech graph 404 is a graph of the speaker saying "I saw a big dog far away from me. I then called it towards me." The tokens/token nodes for this speech are thus "I/saw/big/dog/far/me/I/called/it/towards/me". Note that speech graph 404 has no chains of tokens/nodes, but rather has just two loops. One loop has five nodes (I/saw/big/dog/far) and one loop has four nodes (I/called/it/towards), where the loops return to the initial node "I/me". While speech graph 404 has more loops than speech graph 402, it is also shorter (when measured from top to bottom) than speech graph 402. However, speech graph 404 has the same number of nodes (8) as speech graph 402.

Speech graph 406 is a graph of the speaker saying "I called my friend to take my cat home for me when I saw a dog near me." The tokens/token nodes for this speech are thus "I/called/friend/take/cat/home/for/(me)/saw/dog/near/(me)". While speech graph 406 also has only two loops, like speech graph 404, the size of speech graph 406 is much larger, both in distance from top to bottom as well as the number of nodes in the speech graph 406.

Speech graph 408 is a graph of the speaker saying "I have a small cute dog. I saw a small lost dog." This results in the tokens/token nodes "I/saw/small/lost/dog/(I)/have/small/cute/(dog)". Speech graph 408 has only one loop. Furthermore, speech graph 408 has parallel nodes for "small", which are the same tokens/token nodes for the adjective "small", but are in parallel pathways.

Speech graph 410 is a graph of the speaker saying "I jumped; I cried; I fell; I won; I laughed; I ran." Note that there are no loops in speech graph 410.

In one or more embodiments of the present invention, the speech graphs shown in FIG. 4 are then compared to speech graphs of persons having known features (i.e., are in known categories). For example, assume that 100 persons (a "cohort") speak in a manner that results in a speech graph whose shape is similar to that of speech graph 404 (loop rich; short paths), and these other persons all share a common trait (e.g., are highly educated and are anxious). In this example, if the speech of a new person results in a similar speech graph shape as that shown for speech graph 404, then a conclusion is drawn that this new person may also be highly educated and anxious. Based on this conclusion, future synthetic speech generated by the AI system to communicate with this person will be rapid, as discussed above.

Figure 5:
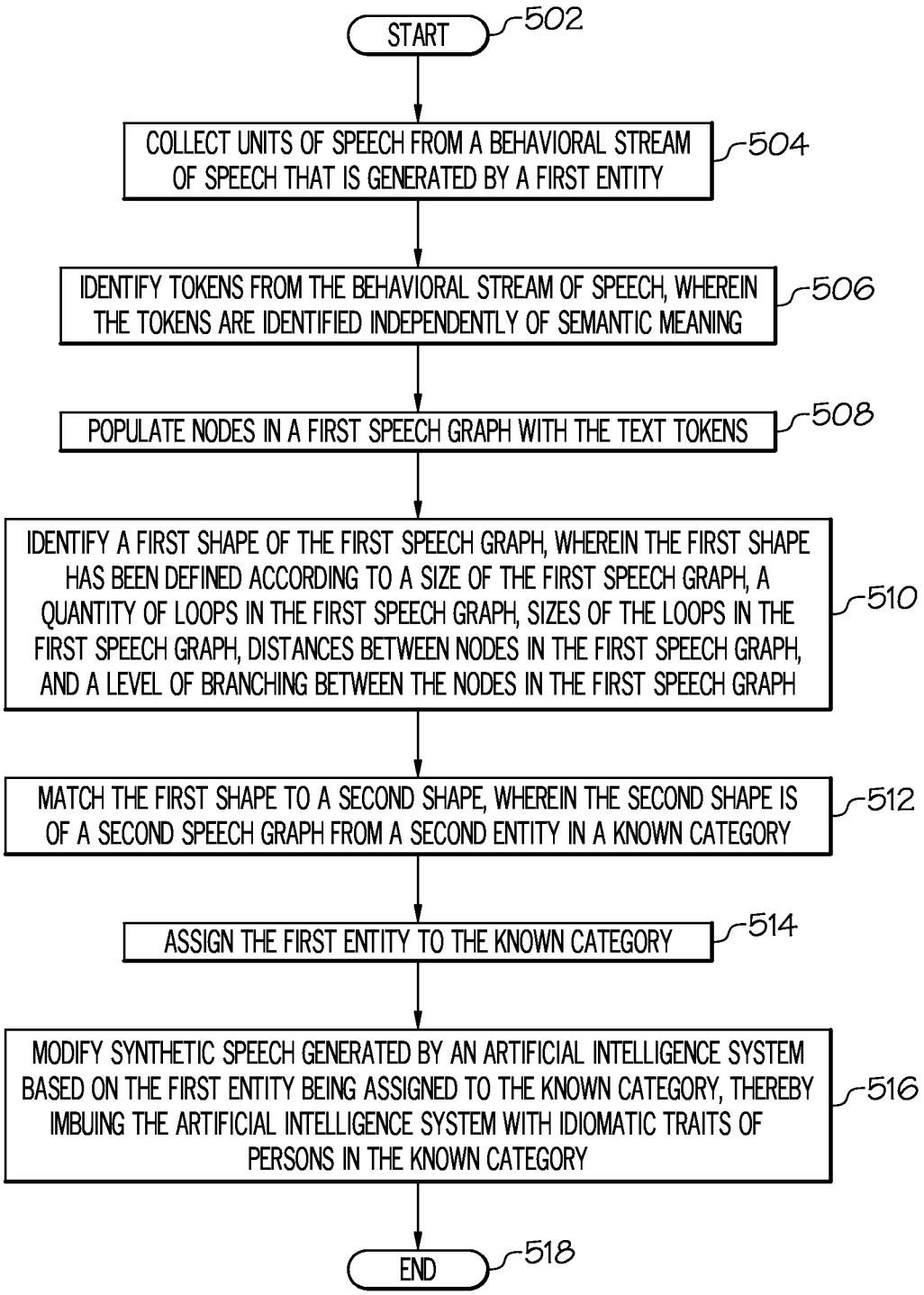
FIG. 5 is a high-level flowchart of one or more steps performed by one or more processors to imbue an artificial intelligence device with synthetic speech that has dialectal traits of a particular cohort/group.

With reference now to FIG. 5, a high-level flowchart of one or more steps performed by one or more processors to modify synthetic speech generated by an AI system based on a speech shape of an entity is presented. After initiator block 502, one or more processors collect electronic units of speech from an electronic stream of speech (block 504). The electronic units of speech are words, lexemes, phrases, etc. that are parts of the electronic stream of speech, which are generated by a first entity (e.g., a prospective student, customer, co-worker, etc.). In one embodiment, the speech is verbal speech. In one embodiment, the speech is text (written) speech. In one embodiment, the speech is non-language gestures/utterances (i.e., vocalizations, such as gasps, groans, etc. which do not produce words/phrases from any human language). In one embodiment, the first entity is a single person, while in another embodiment the first entity is a group of persons.

As described in block 506, tokens from the electronic stream of speech are identified. Each token identifies a particular electronic unit of speech from the electronic stream of speech (e.g., a word, phrase, utterance, etc.). Note that identification of the tokens is semantic-free, such that the tokens are identified independently of a semantic meaning of a respective electronic unit of speech. That is, the initial electronic units of speech are independent of what the words/phrases/utterances themselves mean. Rather, it is only the shape of the speech graph that these electronic units of speech generate that initially matters.

As described in block 508, one or more processors then populate nodes in a first speech graph with the tokens. That is, these tokens define the nodes that are depicted in the speech graph, such as those depicted in FIG. 4.

As described in block 510, one or more processors then identify a first shape of the first speech graph. For example, speech graph 402 in FIG. 4 is identified as having a shape of eight nodes, including a loop of four nodes and a linear string of five nodes. Thus, as described herein and in one embodiment, the first shape of the first speech graph has been defined according to a size of the first speech graph, a quantity of loops in the first speech graph, sizes of the loops in the first speech graph, distances between nodes in the first speech graph, and a level of branching between the nodes in the first speech graph.

As described in block 512, one or more processors then match the first shape to a second shape, wherein the second shape is of a second speech graph from a second entity in a known category. For example, speech graph 404 in FIG. 4 has a particular shape. This particular shape is matched with another speech graph for other persons/entities that are in the known category (e.g., persons who have certain educational levels, are from a certain geographic region, are in a certain emotional state, etc.). As described in block 514, based on this match, the first entity is then assigned to that known category.

As described in block 516, one or more processors then modify synthetic speech generated by an artificial intelligence system based on the first entity being assigned to the known category, thereby imbuing the artificial intelligence system with idiomatic traits of persons in the known category.

The flow-chart ends at terminator block 518.

While the present invention has been described in a preferred embodiment as relying solely on the shape of the speech graph, in one embodiment the contents (semantics, meaning) of the nodes in the speech graph are used to further augment the speech graph, in order to form a hybrid graph of both semantic and non-semantic information (as shown in the graphical overlay chart 330 in FIG. 3). For example, consider the system 600 depicted in FIG. 6. A text input 602 (e.g., from recorded speech of a person) is input into a syntactic feature extractor 604 and a semantic feature extractor 606. The syntactic feature extractor 604 identifies the context (i.e., syntax) of the words that are spoken/written, while the semantic feature extractor 606 identifies the standard definition of the words that are spoken/written. A graph constructor 608 generates a non-semantic graph (e.g., a graph such as those depicted in FIG. 4, in which the meaning of the words is irrelevant to the graph), and a graph feature extractor 610 then defines the shape features of the speech graph. These features, along with the syntax and semantics that are extracted respectively by syntactic feature extractor 604 and semantic feature extractor 606, generate a hybrid graph 612. This hybrid graph 612 starts with the original shape of the non-semantic graph, which has been modified according to the syntax/semantics of the words. For example, while a non-semantic speech graph may still have two loops of 4 nodes each, the hybrid graph will be morphed into slightly different shapes based on the meanings of the words that are the basis of the nodes in the non-semantic speech graph. These changes to the shape of the non-semantic speech graph may include making the speech graph larger or smaller (by "stretching" the graph in various directions), more or less angular, etc.

A learning engine 614 then constructs a predictive model/classifier, which reiteratively determines how well a particular hybrid graph matches a particular trait, activity, etc. of a cohort of persons. This predictive model/classifier is then fed into a predictive engine 616, which outputs (database 618) a predicted behavior and/or physiological category of the current person being evaluated.

Figure 6:
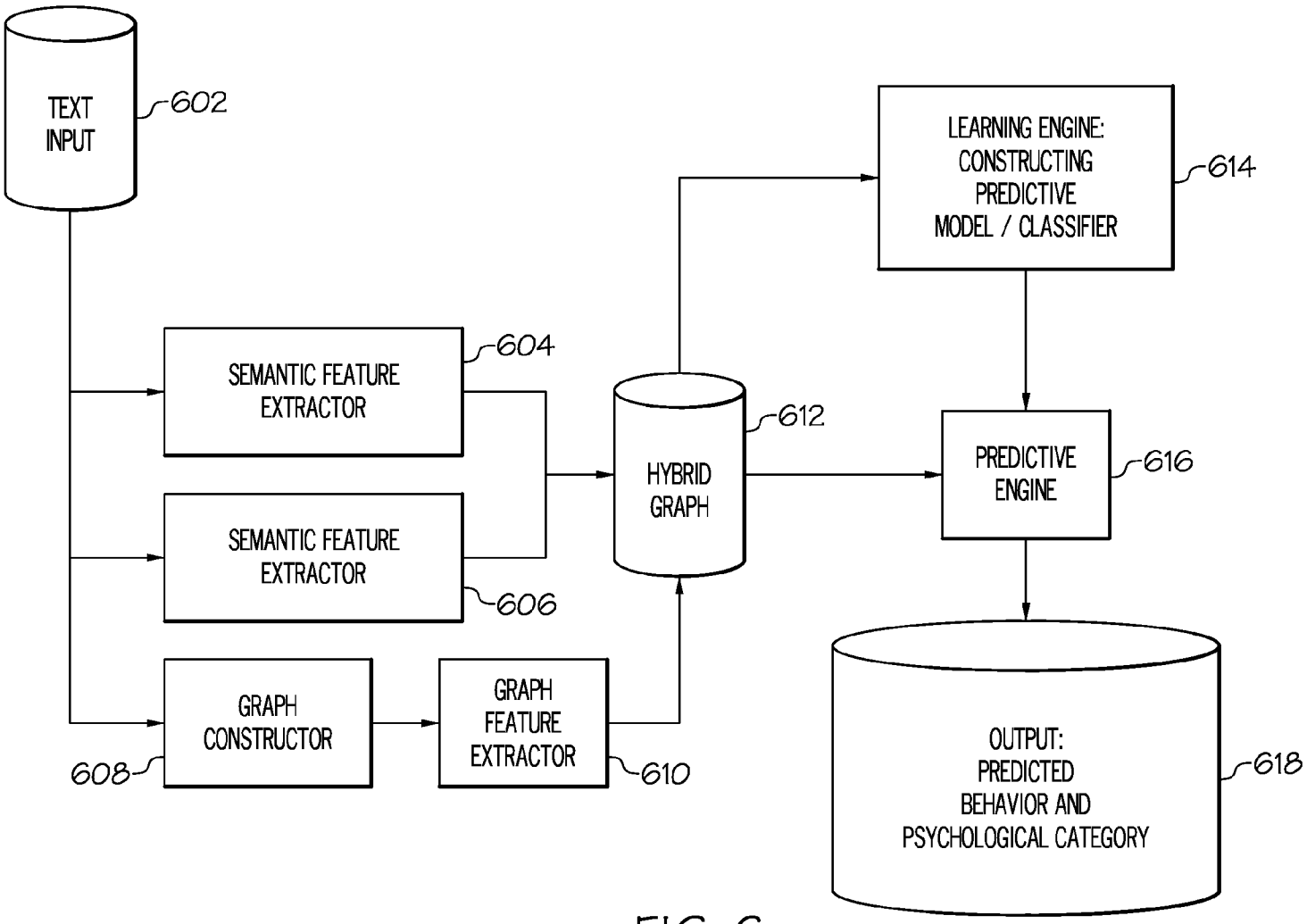
FIG. 6 depicts details of an exemplary graphical text analyzer in accordance with one or more embodiments of the present invention.

In one embodiment of the present invention, the graph constructor 608 depicted in FIG. 6 utilizes a graphical text analyzer, which utilizes the following process.

First, text (or speech-to-text if the speech begins as a verbal/oral source) is fed into a lexical parser that extracts syntactic features, which in their turn are vectorized. For instance, these vectors can have binary components for the syntactic categories verb, noun, pronoun, etc., such that the vector (0, 1, 0, 0, . . . ) that represents a noun-word.

The text is also fed into a semantic analyzer that converts words into semantic vectors. The semantic vectorization can be implemented in a number of ways, for instance using Latent Semantic Analysis. In this case, the semantic content of each word is represented by a vector whose components are determined by the Singular Value Decomposition of word co-occurrence frequencies over a large database of documents; as a result, the semantic similarity between two words a and b can be estimated by the scalar product of their respective semantic vectors:

$$\mathrm{sim}(a,b)=\vec{w}_a\cdot\vec{w}_b.$$

A hybrid graph (G) is then created according to the formula:

$$G=\{N,E,\vec{W}\}$$

in which the nodes N represent words or phrases, the edges E represent temporal precedence in the speech, and each node possesses a feature vector $\vec{W}$ defined as a direct sum of the syntactic and semantic vectors, plus additional non-textual features (e.g. the identity of the speaker):

$$\vec{W}=\vec{w}_{syn}\oplus\vec{w}_{sem}\oplus\vec{w}_{ntxt}$$

The hybrid graph G is then analyzed based on a variety of features, including standard graph-theoretical topological measures of the graph skeleton $G_{sk}$:

$$G_{Sk}=\{N,E\},$$

such as degree distribution, density of small-size motifs, clustering, centrality, etc. Similarly, additional values can be extracted by including the feature vectors attached to each node; one such instance is the magnetization of the generalized Potts model:

$$H=\sum_{n,m}E_{nm}\vec{W}_n\cdot\vec{W}_m$$

such that temporal proximity and feature similarity are taken into account.

These features, incorporating the syntactic, semantic and dynamic components of speech are then combined as a multi-dimensional features vector $\vec{F}$ that represents the speech sample. This feature vector is finally used to train a standard classifier M, where M is defined according to:

$$M=M(\vec{F}_{train},C_{train})$$

to discriminate speech samples that belong to different conditions C, such that for each test speech sample the classifier estimates its condition identity based on the extracted features:

$$C(\mathrm{sample})=M(\vec{F}_{sample}).$$

Thus, in one embodiment of the present invention, wherein the first entity is a person, and wherein the electronic stream of speech is composed of words spoken by the person, the method further comprises:

generating, by one or more processors, a syntactic vector ($\vec{w}_{syn}$) of the words, wherein the syntax vector describes a lexical class of each of the words;

creating, by one or processors, a hybrid graph (G) by combining the first speech graph and a semantic graph of the words spoken by the person, wherein the hybrid graph is created by:

converting, by one or more processors operating as a semantic analyzer, the words into semantic vectors, wherein a semantic similarity (sim(a,b)) between two words a and b are estimated by a scalar product (·) of their respective semantic vectors ($\vec{w}_a \cdot \vec{w}_b$), such that:

$$\text{sim}(a,b)=\vec{w}_a \cdot \vec{w}_b; \text{ and}$$

creating, by one or more processors, the hybrid graph (G) of the first speech graph and the semantic graph, where:

$$G=\{N,E,\vec{W}\}$$

wherein N are nodes, in the hybrid graph, that represent words, E represents edges that represent temporal precedence in the electronic stream of speech, and $\vec{W}$ is a feature vector, for each node in the hybrid graph, and wherein $\vec{W}$ is defined as a direct sum of the syntactic vector ($\vec{w}_{syn}$) and semantic vectors ($\vec{w}_{sem}$), plus an additional direct sum of non-textual features ($\vec{w}_{ntxt}$) of the person speaking the words, such that:

$$\vec{W}=\vec{w}_{syn} \oplus \vec{w}_{sem} \oplus \vec{w}_{ntxt}.$$

The present invention then uses the shape of the hybrid graph (G) to further adjust the synthetic speech that is generated by the AI system.

Figure 7:
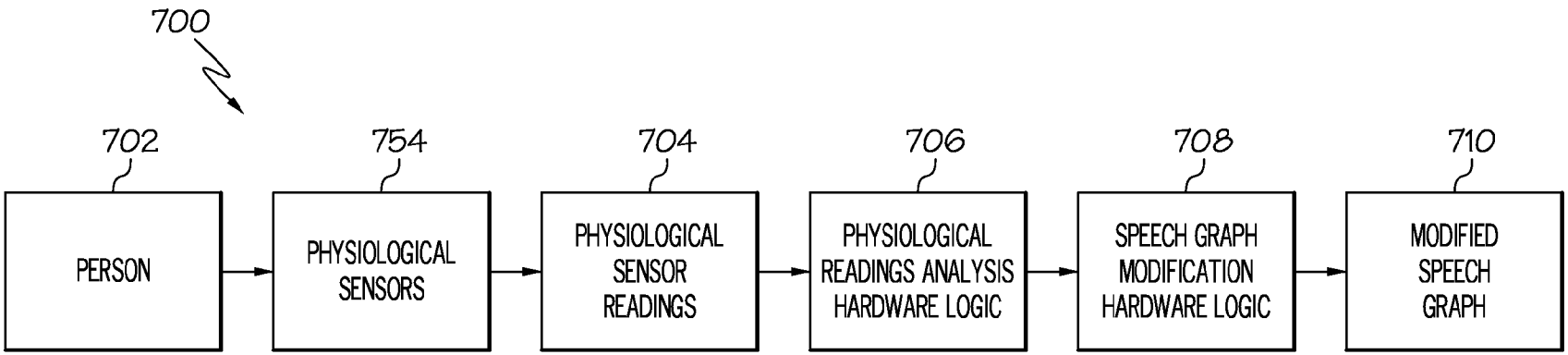
FIG. 7 depicts a process for modifying a speech graph using physiological sensor readings for an individual.

In one embodiment of the present invention, physiological sensors are used to modify a speech graph. With reference now to FIG. 7, a flowchart 700 depicts such an embodiment. A person 702 is connected to (or otherwise monitored by) physiological sensors 754 (analogous to the physiological sensors 154 depicted in FIG. 1), which generate physiological sensor readings 704. These readings are fed into a physiological readings analysis hardware logic 706, which categorizes the readings. For example, the sensor readings may be categorized as indicating stress, fear, evasiveness, etc. of the person 702 when speaking. These categorized readings are then fed into a speech graph modification hardware logic 708, which generates a modified speech graph 710. That is, while an initial speech graph may correlate with speech graphs generated by persons who simply speak rapidly, readings from the physiological sensors 754 may indicate that they are actually experiencing high levels of stress and/or anxiety, and thus their representative speech graphs are modified accordingly.

Thus, in one embodiment of the present invention, the first entity is a person, the electronic stream of speech is a stream of spoken words from the person, and the method further comprises receiving, by one or more processors, a physiological measurement of the person from a sensor, wherein the physiological measurement is taken while the person is speaking the spoken words; analyzing, by one or more processors, the physiological measurement of the person to identify a current emotional state of the person; modifying, by one or more processors, the first shape of the first speech graph according to the current emotional state of the person; and further modifying, by one or more processors, the synthetic speech generated by the artificial intelligence system based on the current emotional state of the person according to the modified first shape.

Similarly to the text input, voice, video and physiological measurements may be directed to the feature-extraction component of the proposed system; each type of measurements may be used to generate a distinct set of features (e.g., voice pitch, facial expression features, heart rate variability as an indicator of stress level, etc.); following the diagram below, the joint set of features, combined with the features extracted from text, may be fed in to a regression model (for predicting real-valued category, such as, for example, level of irritation/anger, or discrete category, such as not-yet-verbalized objective and/or topic).

Figure 8:
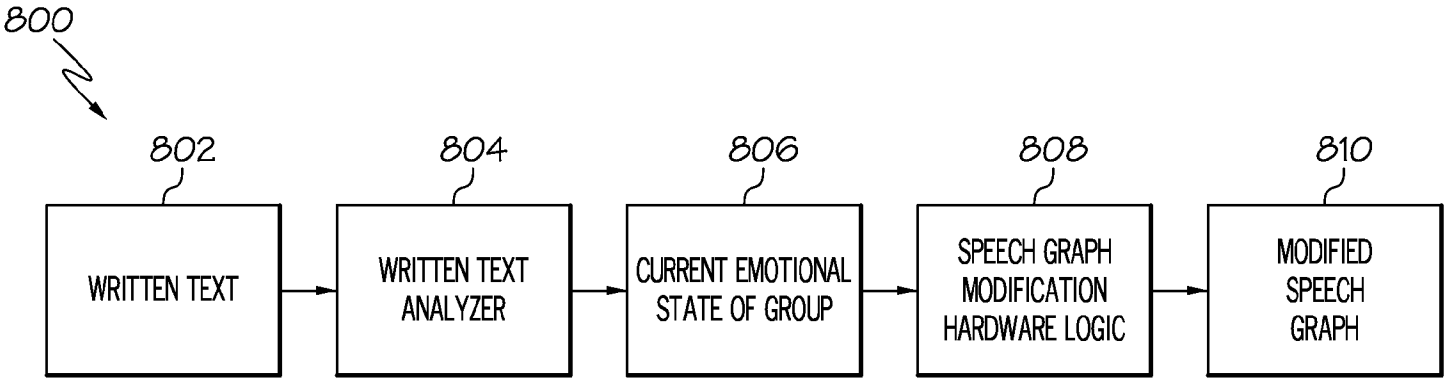
FIG. 8 illustrates a process for modifying a speech graph for a group of persons based on their emotional state, which is reflected in written text associated with the group of persons.

In one embodiment of the present invention, the speech graph is not for a single person, but rather is for a population. For example, a group (i.e., employees of an enterprise, citizens of a particular state/country, members of a particular organization, etc.) may have published various articles on a particular subject. However, "group think" often leads to an overall emotional state of that group (i.e., fear, pride, etc.), which is reflected in these writings. For example, the flowchart 800 in FIG. 8 depicts such written text 802 from a group being fed into a written text analyzer 804. This reveals the current emotional state of that group (block 806), which is fed into speech graph modification logic 808 (similar to the speech graph modification hardware logic 708 depicted in FIG. 7), thus resulting in a modified speech graph 810 (analogous to the modified speech graph 710 depicted in FIG. 7).

Thus, in one embodiment of the present invention, the first entity is a group of persons, the electronic stream of speech is a stream of written texts from the group of persons, and the method further comprises analyzing, by one or more processors, the written texts from the group of persons to identify an emotional state of the group of persons; modifying, by one or more processors, the first shape of the first speech graph according to the emotional state of the group of persons; and adjusting, by one or more processors, the synthetic speech based on a modified first shape of the first speech graph of the group of persons.

In order to increase the confidence level C that a categorization of an individual or a group is correct, a history of categorization may be maintained, along with how such categorization was useful, or not useful, in the context of security. Thus, using active learning, or related, current features and categorizations can be compared to past categorizations and features in order to improve accuracy.

With reference again to the speech graphs presented in FIG. 4, the construction of such speech graphs representing structural elements of speech is based on a number of alternatives, such as syntactic value (article, noun, verb, adjective, etc.), or lexical root (run/ran/running) for the nodes of the graph, and text proximity for the edges of the graph. Graph features such as link degree, clustering, loop density, centrality, etc., also represent speech structure.

Similarly, a number of alternatives are available to extract semantic vectors from the text, such as Latent Semantic Analysis and WordNet. These methods allow the computation of a distance between words and specific concepts (e.g. introspection, anxiety, depression), such that the text can be transformed into a field of distances to a concept, a field of fields of distances to the entire lexicon, or a field of distances to other texts including books, essays, chapters and textbooks.

The syntactic and semantic features may be combined either as "features" or as integrated fields, such as in a Potts model. Similarly, locally embedded graphs are constructed, so that a trajectory in a high-dimensional feature space is computed for each text. The trajectory is used as a measure of coherence of the speech, as well as a measure of distance between speech trajectories using methods such as Dynamic Time Warping.

Other data modalities can be similarly analyzed and correlated with text features and categorization to extend the analysis beyond speech.

The present invention may be implemented using cloud computing, as now described. Nonetheless, it is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based email). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 9:
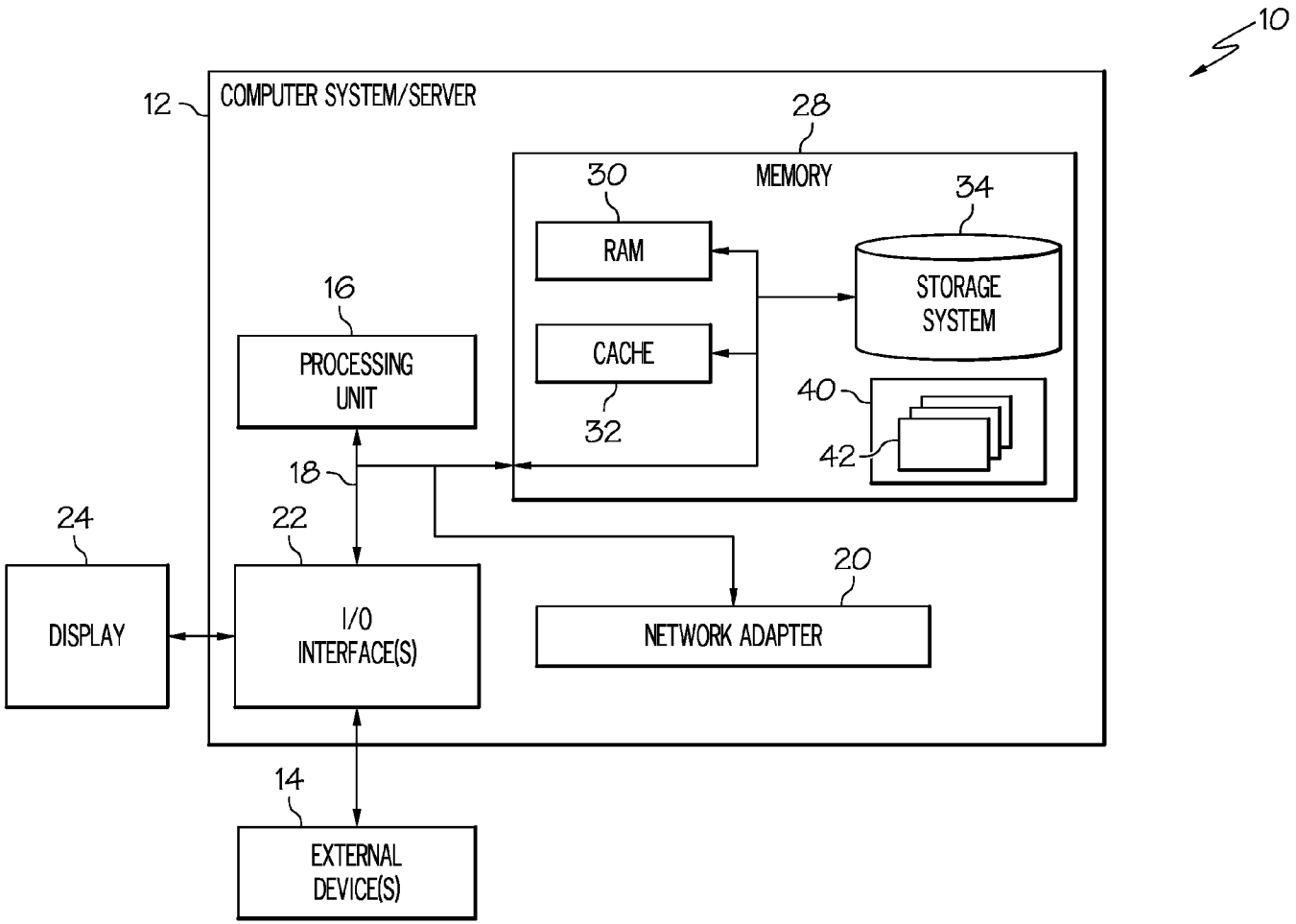
FIG. 9 depicts a cloud computing node according to an embodiment of the present disclosure.

Referring now to FIG. 9, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 9, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 10:
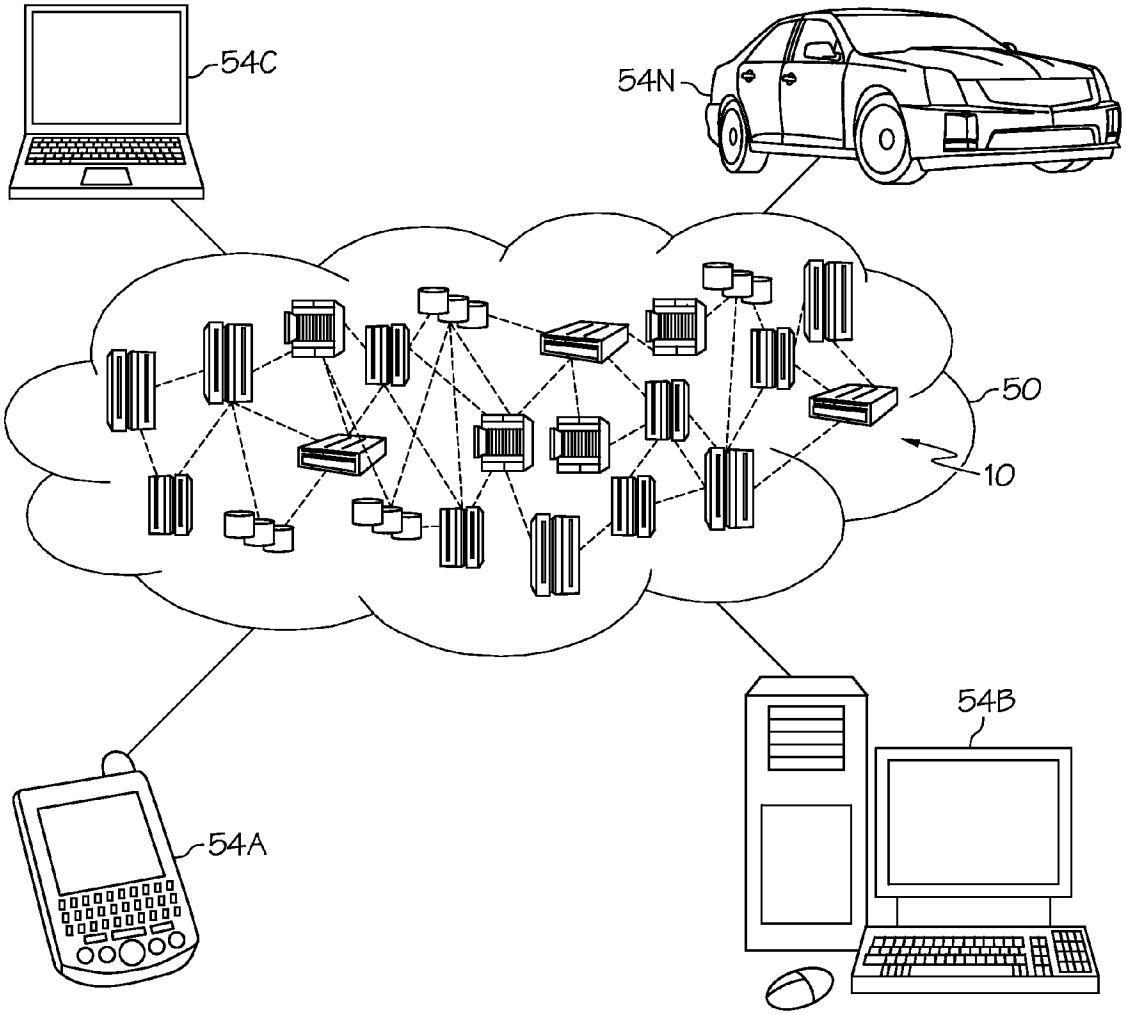
FIG. 10 depicts a cloud computing environment according to an embodiment of the present disclosure.

Referring now to FIG. 10, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 11:
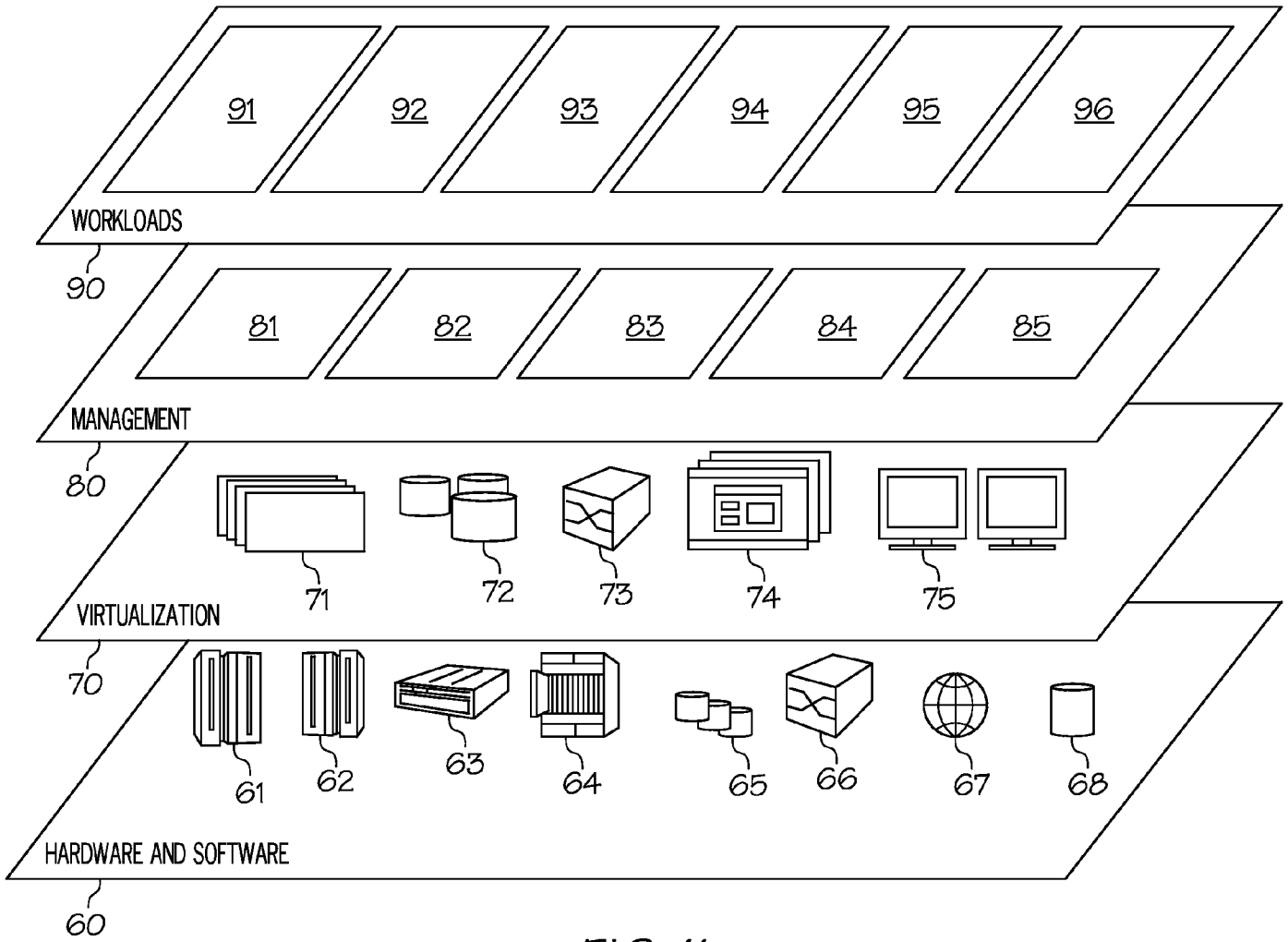
FIG. 11 depicts abstraction model layers according to an embodiment of the present disclosure.

Referring now to FIG. 11, a set of functional abstraction layers provided by cloud computing environment 50 (FIG. 10) is shown. It should be understood in advance that the components, layers, and functions shown in FIG. 11 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and artificial intelligence dialect generation processing 96.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of various embodiments of the present invention has been presented for purposes of illustration and description, but is not intended to be exhaustive or limited to the present invention in the form disclosed. Many modifications and variations will be apparent to those of ordinary skill in the art without departing from the scope and spirit of the present invention. The embodiment was chosen and described in order to best explain the principles of the present invention and the practical application, and to enable others of ordinary skill in the art to understand the present invention for various embodiments with various modifications as are suited to the particular use contemplated.

Any methods described in the present disclosure may be implemented through the use of a VHDL (VHSIC Hardware Description Language) program and a VHDL chip. VHDL is an exemplary design-entry language for Field Programmable Gate Arrays (FPGAs), Application Specific Integrated Circuits (ASICs), and other similar electronic devices. Thus, any software-implemented method described herein may be emulated by a hardware-based VHDL program, which is then applied to a VHDL chip, such as a FPGA.

Having thus described embodiments of the present invention of the present application in detail and by reference to illustrative embodiments thereof, it will be apparent that modifications and variations are possible without departing from the scope of the present invention defined in the appended claims.

What is claimed is:

1. A method of imbuing an artificial intelligence system with idiomatic traits, the method comprising:

collecting, by one or more processors, electronic units of speech from an electronic stream of speech, wherein the electronic stream of speech is generated by a first entity;

identifying, by one or more processors, tokens from the electronic stream of speech, wherein each token identifies a particular electronic unit of speech from the electronic stream of speech, and wherein identification of the tokens is semantic-free such that the tokens are identified independently of a semantic meaning of a respective electronic unit of speech;

populating, by one or more processors, nodes in a first speech graph with the tokens;

identifying, by one or more processors, a first shape of the first speech graph;

matching, by one or more processors, the first shape to a second shape, wherein the second shape is of a second speech graph from a second entity in a known category;

assigning, by one or more processors, the first entity to the known category in response to the first shape matching the second shape; and modifying, by one or more processors, synthetic speech generated by an artificial intelligence system based on the first entity being assigned to the known category, wherein said modifying imbues the artificial intelligence system with idiomatic traits of persons in the known category.

2. The method of claim 1, further comprising:

defining, by one or more processors, the first shape of the first speech graph according to a size of the first speech graph, a quantity of loops in the first speech graph, sizes of the loops in the first speech graph, distances between nodes in the first speech graph, and a level of branching between the nodes in the first speech graph.

3. The method of claim 1, wherein the first entity is a person, wherein the electronic stream of speech is an electronic recording of a stream of spoken words from the person, and wherein the method further comprises:

receiving, by one or more processors, a physiological measurement of the person from a sensor, wherein the physiological measurement is taken while the person is speaking the spoken words;

analyzing, by one or more processors, the physiological measurement of the person to identify a current emotional state of the person;

modifying, by one or more processors, the first shape of the first speech graph according to the current emotional state of the person; and further modifying, by one or more processors, the synthetic speech generated by the artificial intelligence system based on the current emotional state of the person according to the modified first shape.

4. The method of claim 1, wherein the first entity is a group of persons, wherein the electronic stream of speech is a stream of written texts from the group of persons, and wherein the method further comprises:

analyzing, by one or more processors, the written texts from the group of persons to identify an emotional state of the group of persons;

modifying, by one or more processors, the first shape of the first speech graph according to the emotional state of the group of persons; and adjusting, by one or more processors, the synthetic speech based on a modified first shape of the first speech graph of the group of persons.

5. The method of claim 1, wherein the first entity is a person, wherein the electronic stream of speech is composed of words spoken by the person, and wherein the method further comprises:

generating, by one or more processors, a syntactic vector ($\vec{w}_{syn}$) of the words, wherein the syntactic vector describes a lexical class of each of the words;

creating, by one or processors, a hybrid graph (G) by combining the first speech graph and a semantic graph of the words spoken by the person, wherein the hybrid graph is created by:

converting, by one or more processors operating as a semantic analyzer, the words into semantic vectors, wherein a semantic similarity (sim(a,b)) between two words a and b are estimated by a scalar product (·) of their respective semantic vectors ($\vec{w}_a \cdot \vec{w}_b$), such that:

$$\mathrm{sim}(a,b)=\vec{w}_a \cdot \vec{w}_b;$$

creating, by one or more processors, the hybrid graph (G) of the first speech graph and the semantic graph, where:

$$G=\{N,E,\vec{W}\}$$

wherein N are nodes, in the hybrid graph, that represent words, E represents edges that represent temporal precedence in the electronic stream of speech, and $\vec{W}$ is a feature vector, for each node in the hybrid graph, and wherein $\vec{W}$ is defined as a direct sum of the syntactic vector ($\vec{w}_{syn}$) and semantic vectors ($\vec{w}_{sem}$), plus an additional direct sum of non-textual features ($\vec{w}_{ntxt}$) of the person speaking the words, such that:

$$\vec{W}=\vec{w}_{syn} \oplus \vec{w}_{sem} \oplus \vec{w}_{ntxt}; \text{ and}$$

further adjusting, by one or more processors, the synthetic speech based on a shape of the hybrid graph (G).

6. The method of claim 1, wherein the electronic stream of speech comprises spoken non-language gestures from the first entity.

7. The method of claim 1, wherein the known category is a demographic group.

8. The method of claim 1, wherein the known category is an occupational group.

9. The method of claim 1, wherein the known category is for a group having a common level of education.

10. A computer program product for imbuing an artificial intelligence system with idiomatic traits, the computer program product comprising a tangible computer readable storage medium having program code embodied therewith, wherein the program code is readable and executable by a processor to perform a method comprising:

collecting electronic units of speech from an electronic stream of speech, wherein the electronic stream of speech is generated by a first entity;

identifying tokens from the electronic stream of speech, wherein each token identifies a particular electronic unit of speech from the electronic stream of speech, and wherein identification of the tokens is semantic-free such that the tokens are identified independently of a semantic meaning of a respective electronic unit of speech;

populating nodes in a first speech graph with the tokens;

identifying a first shape of the first speech graph;

matching the first shape to a second shape, wherein the second shape is of a second speech graph from a second entity in a known category;

assigning the first entity to the known category in response to the first shape matching the second shape; and modifying synthetic speech generated by an artificial intelligence system based on the first entity being assigned to the known category, wherein said modifying imbues the artificial intelligence system with idiomatic traits of persons in the known category.

11. The computer program product of claim 10, wherein the method further comprises:

defining the first shape of the first speech graph according to a size of the first speech graph, a quantity of loops in the first speech graph, sizes of the loops in the first speech graph, distances between nodes in the first speech graph, and a level of branching between the nodes in the first speech graph.

12. The computer program product of claim 10, wherein the first entity is a person, wherein the electronic stream of speech is a stream of spoken words from the person, and wherein the method further comprises:

receiving a physiological measurement of the person from a sensor, wherein the physiological measurement is taken while the person is speaking the spoken words;

analyzing the physiological measurement of the person to identify a current emotional state of the person;

modifying the first shape of the first speech graph according to the current emotional state of the person; and further modifying the synthetic speech generated by the artificial intelligence system based on the current emotional state of the person according to the modified first shape.

13. The computer program product of claim 10, wherein the first entity is a group of persons, wherein the electronic stream of speech is a stream of written texts from the group of persons, and wherein the method further comprises:

analyzing the written texts from the group of persons to identify a current emotional state of the group of persons;

modifying the first shape of the first speech graph according to the current emotional state of the group of persons; and adjusting the synthetic speech based on a modified first shape of the first speech graph of the group of persons.

14. The computer program product of claim 10, wherein the first entity is a person, wherein the electronic stream of speech is composed of words spoken by the person, and wherein the method further comprises:

generating a syntactic vector ($\vec{w}_{syn}$) of the words, wherein the syntactic vector describes a lexical class of each of the words;

creating a hybrid graph (G) by combining the first speech graph and a semantic graph of the words spoken by the person, wherein the hybrid graph is created by:

converting the words into semantic vectors, wherein a semantic similarity (sim(a,b)) between two words a and b are estimated by a scalar product (·) of their respective semantic vectors ($\vec{w}_a \cdot \vec{w}_b$), such that:

$$\mathrm{sim}(a,b)=\vec{w}_a \cdot \vec{w}_b; \text{ and}$$

creating the hybrid graph (G) of the first speech graph and the semantic graph, where:

$$G=\{N,E,\vec{W}\}$$

wherein N are nodes, in the hybrid graph, that represent words, E represents edges that represent temporal precedence in the electronic stream of speech, and $\vec{W}$ is a feature vector, for each node in the hybrid graph, and wherein $\vec{W}$ is defined as a direct sum of the syntactic vector ($\vec{w}_{syn}$) and semantic vectors ($\vec{w}_{sem}$), plus an additional direct sum of non-textual features ($\vec{w}_{ntxt}$) of the person speaking the words, such that:

$\vec{W}=\vec{w}_{syn}\oplus\vec{w}_{sem}\oplus\vec{w}_{nxt}$; and further adjusting the synthetic speech based on a shape of the hybrid graph (G).

15. The computer program product of claim 10, wherein the electronic stream of speech comprises spoken non-language gestures from the first entity.

16. The computer program product of claim 10, wherein the known category is a demographic group.

17. The computer program product of claim 10, wherein the known category is an occupational group.

18. The computer program product of claim 10, wherein the known category is for a group having a common level of education.

19. A computer system comprising:

a processor, a computer readable memory, and a tangible computer readable storage medium;

first program instructions to collect electronic units of speech from an electronic stream of speech, wherein the electronic stream of speech is generated by a first entity;

second program instructions to identify tokens from the electronic stream of speech, wherein each token identifies a particular electronic unit of speech from the electronic stream of speech, and wherein identification of the tokens is semantic-free such that the tokens are identified independently of a semantic meaning of a respective electronic unit of speech;

third program instructions to populate nodes in a first speech graph with the tokens;

fourth program instructions to identify a first shape of the first speech graph;

fifth program instructions to match the first shape to a second shape, wherein the second shape is of a second speech graph from a second entity in a known category;

sixth program instructions to assign the first entity to the known category in response to the first shape matching the second shape; and seventh program instructions to modify synthetic speech generated by an artificial intelligence system based on the first entity being assigned to the known category, wherein said modifying imbues the artificial intelligence system with idiomatic traits of persons in the known category; and wherein the first, second, third, fourth, fifth, sixth, and seventh program instructions are stored on the tangible computer readable storage medium and executed by the processor via the computer readable memory.

20. The computer system of claim 19, further comprising:

eighth program instructions to define the first shape of the first speech graph according to a size of the first speech graph, a quantity of loops in the first speech graph, sizes of the loops in the first speech graph, distances between nodes in the first speech graph, and a level of branching between the nodes in the first speech graph; and wherein the eighth program instructions are stored on the tangible computer readable storage medium and executed by the processor via the computer readable memory.

* * * * *